United States Patent [19]

Martin

[11] 4,203,834

[45] May 20, 1980

[54] HYDROCYCLONE UNDERFLOW DENSITY CONTROL

[75] Inventor: David L. Martin, Woodside, Calif.

[73] Assignee: Krebs Engineers, Menlo Park, Calif.

[21] Appl. No.: 935,525

[22] Filed: Aug. 21, 1978

Related U.S. Application Data

[63] Continuation-in-part of Ser. No. 871,391, Jan. 23, 1978.

[51] Int. Cl.[2] ..... B04C 5/16

[52] U.S. Cl. ..... 209/211; 210/512 R

[58] Field of Search ..... 209/211, 144, 496, 494; 210/512 R, 512 M, 113; 137/843, 844, 846–849; 222/494, 490, 212, 213, 527, 529; 55/432

[56] References Cited

U.S. PATENT DOCUMENTS

| | | | |
|---|---|---|---|
| 3,034,647 | 5/1962 | Giesse | 209/211 X |
| 3,575,521 | 4/1971 | Porter et al. | 137/849 X |
| 3,589,107 | 6/1971 | Vines | 55/432 |
| 3,861,416 | 1/1975 | Wichterle | 137/849 |
| 3,923,210 | 12/1975 | Jackson | 222/494 |

*Primary Examiner*—Ralph J. Hill

*Attorney, Agent, or Firm*—Flehr, Hohbach, Test, Albritton & Herbert

[57] ABSTRACT

Hydrocyclone apparatus having means for controlling the gravity of the discharging underflow which consists of a device formed of resilient material that is mounted directly below the apex opening of the hydrocyclone. The device provides a plurality of sectors which when relaxed extend inwardly toward the hydrocyclone axis, with the side edges of each sector in juxtaposition with adjacent sectors. When the hydrocyclone is operating the downward thrust of underflow material directly overlying the device causes the sectors to be deflected downwardly to so control the underflow as to maintain its density substantially constant irrespective of changes in the density of the slurry supplied to the inlet. Preferably the construction of the device is such that when the sectors are relaxed they are arched upwardly.

4 Claims, 9 Drawing Figures

HYDROCYCLONE UNDERFLOW DENSITY CONTROL

CROSS-REFERENCE TO RELATED APPLICATION

This application is a continuation-in-part of my copending application Ser. No. 871,391 filed Jan. 23, 1978, and entitled "Hydrocyclone Apparatus and Method for Underflow Density Control".

BACKGROUND OF THE INVENTION

This invention relates generally to hydrocyclone apparatus and methods for controlling the density of discharging underflow.

Hydrocyclones are commonly used in many industries for carrying out concentrating, clarifying and classifying operations on various mineral slurries, pulps and liquids containing undissolved solids. Briefly, when disposed in upright position, a hydrocyclone consists of a separating chamber that is annular in section with a lower conical portion having an underflow discharge opening at its apex end. The separating chamber also has means forming an inlet opening connected tangentially with the upper head portion of the chamber, and means forming an overflow outlet which communicates with a vortex finder disposed axially within the head portion of the chamber. When in operation, feed is supplied under pressure to the inlet and swirling movement of the body of material within the chamber causes centrifugal separation whereby heavier separated solids are discharged in an underflow from the apex end of the chamber, and the lighter solids are discharged through the vortex finder and the overflow outlet. For concentrating, or where it is desired to provide a clarified overflow, the operation is such that substantially all of the solid material of the feed is discharged with the underflow. For classification, heavier solids are discharged in the underflow and lighter solids in the overflow.

A common problem in the operation of hydrocyclones has been the maintenance of a constant high density (solid to liquid ratio) underflow material while operating under conditions where the density of cyclone feed fluctuates over wide limits. Such fluctuations are experienced for example in mineral slurries produced by continuously operating product preparation circuits. By way of example, in instances where a sand-gravel preparation circuit is supplying feed to a hydrocyclone, the density of the feed may vary from less than 1% to more than 25%, with the result that the underflow is subjected to corresponding fluctuations in density. Such variations may cause serious resulting problems in the handling and further processing of the underflow.

In the past, various methods and types of equipment have been employed in an effort to control the density of the underflow. For example, in some instances variations in density of the overflow have been detected by various devices, with the detecting device connected to control the circuit which is preparing the feed. Such equipment is relatively expensive and the control provided is not as accurate as is frequently desired, due to deficiencies in the detecting devices, inability to effectively control the preparation circuit, or both. Less elaborate devices that have been employed include collapsible tubing of resilient material, flap valves, and counterbalanced piping arrangements applied to the apex of the hydrocyclone to effect some control over the discharge of underflow in accordance with change in density. Use of such devices has resulted in increased maintenance requirements of the hydrocyclone circuit, cyclone choking or plugging, and aberrant performance. In addition, such devices do not provide maintenance of the underflow density within the flow limits frequently desired.

OBJECTS OF THE INVENTION AND SUMMARY

In general it is an object of the invention to provide a hydrocyclone apparatus and method which will enable control of the underflow density within relatively close limits, irrespective of relatively wide variations in density of the feed material.

Another object is to provide an apparatus and method which is relatively simple and inexpensive, and which can be incorporated with hydrocyclones of conventional construction.

Another object is to provide an apparatus and method which is relatively free of maintenance requirements, which avoids cyclone choking or plugging, and which in general prevents aberrant performance of the hydrocyclone.

In general, the invention comprises a hydrocyclone having a separating chamber that is annular in section with a lower conical shaped portion having an opening at its lower apex end for discharge of an underflow containing separated solids. The chamber is provided with an inlet opening connected tangentially with the upper head portion of the chamber and an overflow outlet communicating with an inner vortex finder disposed axially of the chamber within the head portion. The control means consists of a device made of resilient material which is mounted directly below the apex opening. This device is so constructed that it consists of a plurality of sectors which when relaxed extend with their apexes adjacent the axis of the hydrocyclone, with the side edges of each sector extending radially from the axis. Preferably the sectors are constructed whereby they are arched upwardly into the apex opening. The sectors are deflected downwardly by the thrust of underflow material with the discharge being controlled in such a manner that the density of the discharging material is maintained substantially constant.

Additional objects and features of the invention will appear from the following description in which the preferred embodiment has been disclosed in detail in conjunction with the accompanying drawing.

DESCRIPTION OF THE PREFERRED EMBODIMENT

Figure 1:
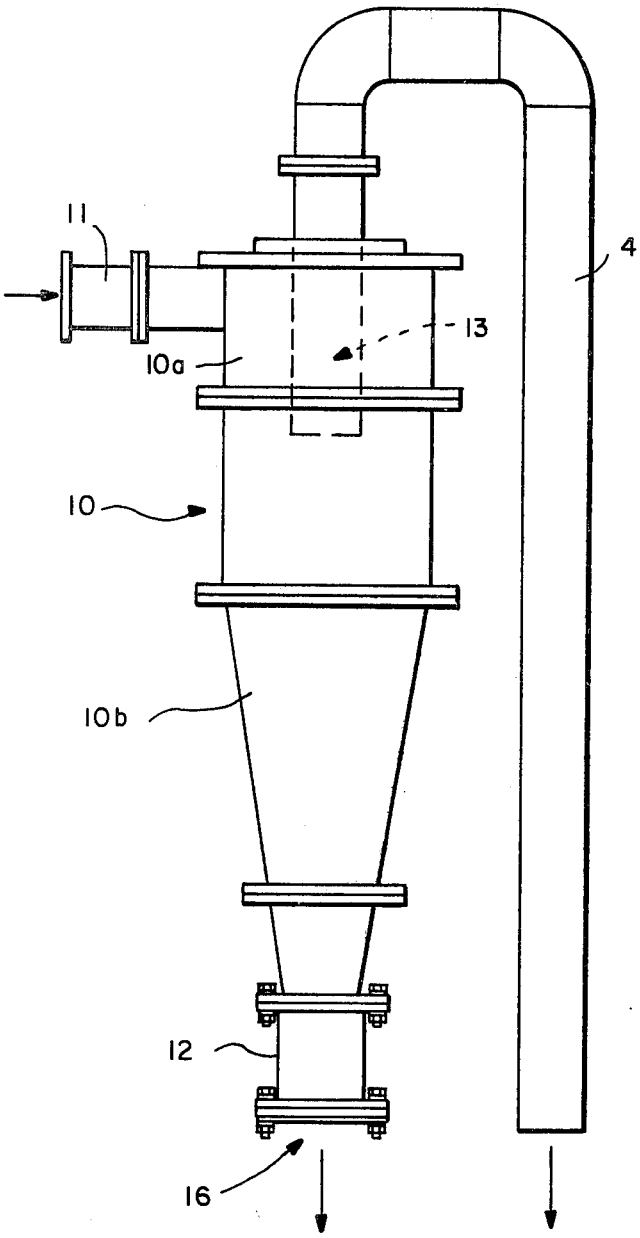
FIG. 1 is a side elevational view illustrating a conventional hydrocyclone equipped with control means according to the present invention.

The hydrocyclone shown in FIG. 1 consists of means forming a separating chamber 10, the upper portion 10*a* of which is connected tangentially to the inlet 11, and the lower portion 10*b* being conical and terminating in the apex 12. The interior of the chamber is provided with the usual vortex finder 13 which is aligned with the axis of the chamber and which connects with the outlet pipe 14. When feed is supplied under pressure to the inlet, the body of the material within the chamber is caused to swirl about the central axis, thus creating separating forces resulting in discharge of an underflow through the apex 12 and an overflow through the vortex finder 13 and outlet 14. The overflow outlet piping 14 generally extends to a level below the apex 12 to enhance its suction effect.

The lower apex portion 12 may consist of a body 18 which is annular in section and which is bolted or otherwise secured to the adjacent conical body portion. The body is shown fitted with a liner 19 such as is commonly used in hydrocyclones and which may be of suitable wear resisting material such as a synthetic rubber or elastomer or a suitable ceramic material. The body 18 together with the liner 19 serves to form the lower end of the hydrocyclone. Centrifugally separated underflow is received in the space 21 within the liner 19 and under typical operating conditions the material within this space consists of heavy centrifugally separated solids together with some liquid. There is sufficient movement of material in space 21 whereby it constitutes a working mass.

Figure 6:
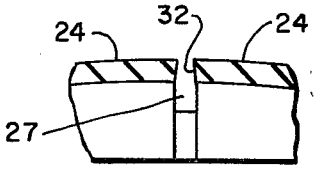
FIG. 6 is a detail in section taken along the line 6—6 of FIG. 3.

The control means 16 consists of the member 22 which is secured directly to the lower end of the body 18 and extends across the lower end of the space 21. It is made of suitable resilient material such as a synthetic rubber or elastomer and is formed to provide the flexible sectors 24 and the outer annular margin 26. The side edges of the sectors are separated by the radially extending slots 27. The inner ends of the slots 27 terminate in the central hole 28 which is aligned with the central longitudinal axis of the hydrocyclone. Preferably the sectors are arched upwardly and inwardly with respect to the space 21, as shown in FIG. 1. Each sector is shown provided with an intergral underlying reinforcing rib 31 which extends from the annular portion 26 to the apex end of each sector. The edge faces 32 of each sector are relieved in the manner shown in FIG. 6 so that each slot 27 appears as shown in FIG. 6 for relaxed condition of the sectors. In other words, for this condition the slots 27 as viewed in section conform to an inverted "V". The slots 27 are of such width that when the sectors are simultaneously deflected or flexed downwardly, the edges of the sectors are not pressed into contact. The downwardly divergent slots tend to be self-clearing with respect to solid material, thus preventing clogging.

Figure 3:
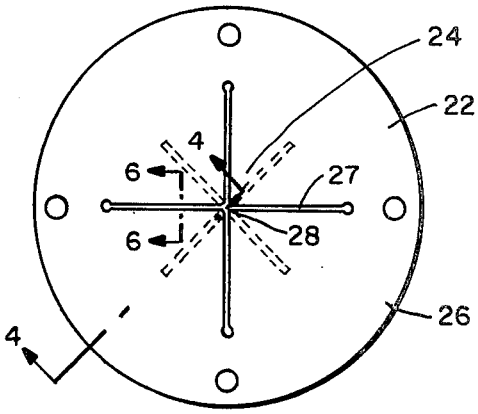
FIG. 3 is a plan view of the control device incorporated in the hydrocyclone.
Figure 4:
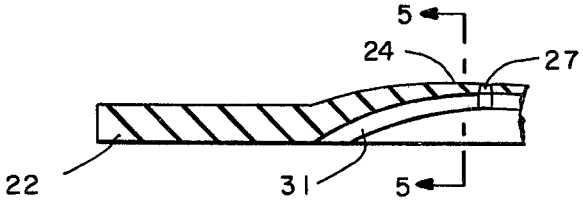
FIG. 4 is a cross-sectional detail on an enlarged scale taken along the line 4—4 of FIG. 3.
Figure 5:
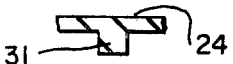
FIG. 5 is a detail in section taken along the line 5—5 of FIG. 4.

The device shown in FIG. 3 is suitably secured directly to the lower end of the body 18. Thus the annular portion 27 is shown clamped against the lower side of the body flange 33 by the clamping ring 34 and clamping bolts 36.

Figure 2:
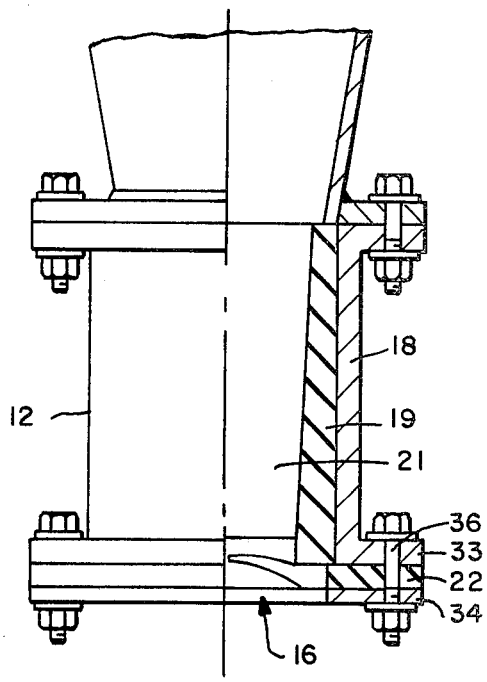
FIG. 2 is a detail on an enlarged scale and in half section showing the lower portion of the hydrocyclone, including the control device.
Figure 7:
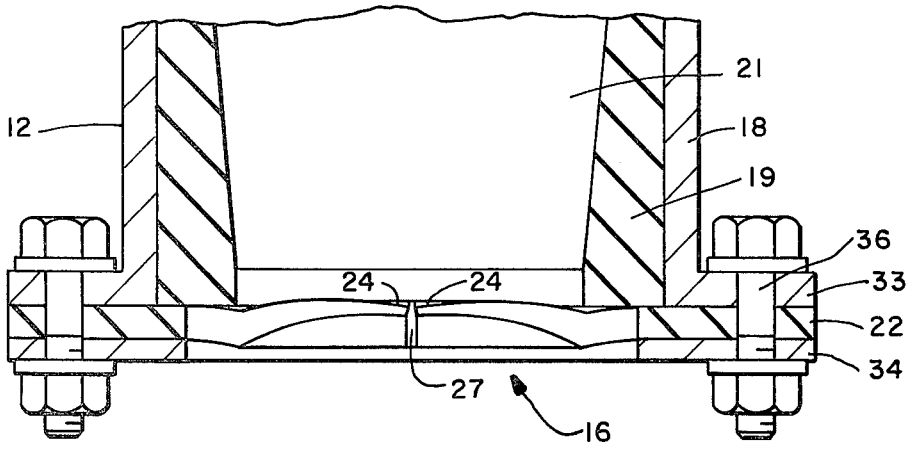
FIGS. 7, 8 and 9 are views in section showing the lower portion of the hydrocyclone and illustrating three different positions of the resilient sectors.
Figure 8:
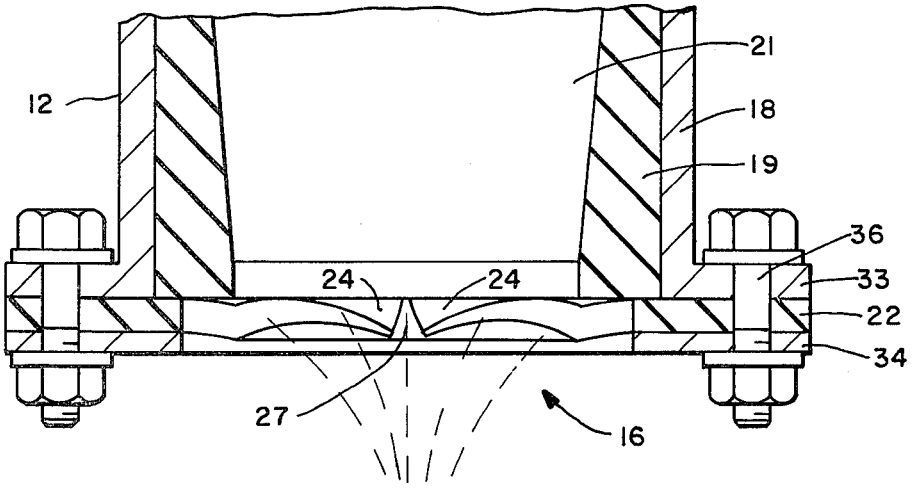
Figure 9:
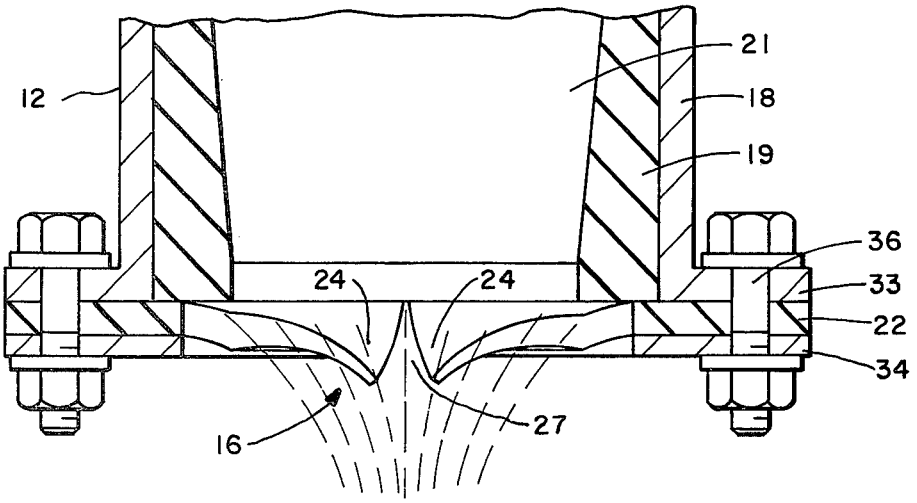

Operation of the apparatus and the method involved are as follows. Assuming that the feed slurry consists of both heavier and lighter solids, it is supplied under pressure to the inlet 11 to the hydrocyclone chamber whereby centrifugal forces effect separation between lighter and heavier solids. The lighter solids discharge in an overflow through the vortex finder 13 and outlet pipe 14. Heavier separated solids report to the space 21 immediately above the control means 16 for discharge in the underflow. During the start-up phase and before there has been an opportunity for a substantial amount of heavier solids to accumulate within the space 21, the weight of material within the hydrocyclone chamber causes the sectors 24 to be deflected downwardly to a position such as shown in FIG. 7. In this position the apexes of the sectors are in a plane corresponding generally to the plane of the annular portion 26, and there is sufficient space between the edges 32 of the sectors to permit a limited amount of material to discharge. As the operation proceeds and the hydrocyclone approaches what may be termed normal operating condition, the weight and downward thrust of underflow material in space 21 is sufficient to deflect the sectors to a greater extent, as for example, to the position shown in FIG. 2. This widens the spaces between the edges of the sectors and also flexes the apexes of the sectors away from the central axis, whereby a greater amount of underflow is permitted to discharge. If the conditions of operation change due, for example, to a change in the density of the feed material, such changes serve to change the thrust exerted by the underflow material against the sectors whereby the deflection and rate of underflow discharge is varied to maintain the underflow density substantially constant. If the thrust against the sectors increases, the sectors may deflect to the further position shown in FIG. 9.

It will be evident that the simple control means described above is effective in maintaining the underflow substantially constant, irrespective of changes in the density of the feed, while the overflow outlet pipe 14 is capable of exerting some suction or siphoning action. When the feed density is minimum, the control means exerts substantial restriction to the underflow discharge by partially blocking off the apex opening. This has the effect of increasing the amount of overflow liquid being discharged through the outlet while the heavier solids of the feed continue to report to the underflow in the apex portion of the separating chamber, with the overflow discharge being aided by the suction or siphoning action of the pipe 14.

In laboratory testing of the invention it has been found possible to control the underflow density to within a variation of about 3% by weight for density variations of feed ranging from 1 to 25% solids (by weight).

As previously mentioned, the hydrocyclone may be of conventional construction except for the control means and its manner of application. The design of the hydrocyclone should be such that there is a proper ratio of vortex finder diameter to the diameter of the apex opening provided by the liner 19, as for example, ratios ranging from 2:1 to 3:1.

In addition to providing a control serving to maintain the density of the underflow substantially constant irrespective of changes in the density of the feed, the invention serves to maintain the underflow density substantially constant for substantial changes in the rate of feed. Such changes may occur in various hydrocyclone installations. For example, in installations where the feed is pumped to a manifold to which a plurality of hydrocyclones are connected, the rate of feed to particular ones of the hydrocyclones may vary. Also in some installations the pumping means or other source of feed under pressure may be subject to variations in the rate of discharge for purposes of control.

In general, the invention is simple in construction and operation. The thrust of the underflow upon the flexible sectors is dependent upon the density of the underflow in the apex end portion of the hydrocyclone, rather than upon density control apparatus which receives underflow from the hydrocyclone. In operation it is relatively free of plugging, and any oversize solids are readily passed between the sectors without materially affecting the control of density. Freedom from plugging is attributed in part to the fact that the underflow material in space 21 is a working mass, rather than a mass of solids that are relatively static and in settled condition.

What is claimed is:

1. A hydrocyclone which when in upright position has a separating chamber that is annular in section with a lower conical shaped portion having an opening at its lower apex end for discharge of an underflow containing heavier separated solids, the chamber also having means forming an inlet opening connected tangentially with the upper portion of the chamber and means forming an overflow outlet communicating with a vortex finder disposed axially of the chamber for discharge of overflow material, control means secured directly to the lower end of the hydrocyclone, said control means consisting of a device made of resilient material, said device having a plurality of flexible sectors, said sectors when relaxed extending across the apex opening, the apex end of each sector being substantially aligned with the axis of the chamber with its side edges extending generally radially from the perimeter of the apex opening to the central axis of the hydrocyclone, the side edges of each sector when relaxed being in juxtaposition with the side edges of adjacent sectors but spaced therefrom, said sectors being so constructed that they present increasing resistance to downward deflection and being deflected downwardly by the thrust of underflow material overlying the same, resistance to such deflection serving as means to effect controlled underflow discharge, whereby the density of the discharging underflow material is maintained substantially constant.

2. A hydrocyclone as in claim 1 in which the sectors are integral with an annulus of resilient material, said annulus being secured to the lower end of the hydrocyclone.

3. A hydrocyclone as in claim 1 in which the sectors are arched upwardly when relaxed.

4. A hydrocyclone as in claim 1 in which the spaces between the side edges of adjacent sectors, when the sectors are relaxed, are in the form of an inverted "V" as viewed in section.

* * * * *